US011731175B1

(12) United States Patent
Bartucciotto

(10) Patent No.: US 11,731,175 B1
(45) Date of Patent: Aug. 22, 2023

(54) HIGH-SPEED CHAIN CUTTER APPARATUS TO CLEAN AND DESCALE PIPES

(71) Applicant: John Herbert Bartucciotto, Garden Grove, CA (US)

(72) Inventor: John Herbert Bartucciotto, Garden Grove, CA (US)

(73) Assignee: EPL Solutions, Inc., Orange, CA (US)

( * ) Notice: Subject to any disclaimer, the term of this patent is extended or adjusted under 35 U.S.C. 154(b) by 263 days.

(21) Appl. No.: 17/353,307

(22) Filed: Jun. 21, 2021

Related U.S. Application Data

(60) Provisional application No. 63/013,397, filed on Apr. 21, 2020.

(51) Int. Cl.
*B08B 9/045* (2006.01)

(52) U.S. Cl.
CPC ..... *B08B 9/045* (2013.01)

(58) Field of Classification Search
CPC ..... B08B 9/0436; B08B 9/045; B08B 9/047; B08B 2209/04; E03C 1/302; E03F 9/005
USPC ..... 15/104.09, 104.31, 104.33
See application file for complete search history.

(56) References Cited

U.S. PATENT DOCUMENTS 2,223,005 A * 11/1940 Kerber ..... E03F 9/005 226/76
2,244,735 A * 6/1941 Silverman ..... B08B 9/0436 15/104.33
3,159,861 A * 12/1964 Sarcone ..... E03F 9/005 254/134.3 R
4,644,603 A * 2/1987 Meyer ..... B08B 9/045 15/104.33
5,107,550 A * 4/1992 Hawro ..... E03F 9/005 4/255.08
6,470,525 B1 * 10/2002 Silverman ..... E03F 9/005 15/104.33
2004/0069331 A1 * 4/2004 Garman ..... F28G 15/04 134/179
2010/0017981 A1 * 1/2010 Hamm ..... B08B 9/0436 15/104.33

FOREIGN PATENT DOCUMENTS

EP 0911452 A2 * 4/1999
GB 2142944 A * 1/1985 ..... E03F 9/005

* cited by examiner

*Primary Examiner* — Don M Anderson
*Assistant Examiner* — Ian James Geiger
(74) *Attorney, Agent, or Firm* — Plager Schack LLP; Mark H. Plager; Kara Verryt

(57) ABSTRACT

A high-speed chain cutter apparatus with a self-lubrication capability that is configured to clean and descale a pipe may include a basket plate mounted to a cart frame; a motor coupled to the basket plate; a cable having a proximal end and a distal end, wherein the proximal end is operably coupled to the motor; an outer tubular member disposed around the cable and positioned to expose both a first portion of the cable proximate to the proximal end and the distal end of the cable; and an oil block coupled to the basket plate, wherein the oil block includes a bore, wherein the first portion of the cable extends through the bore and wherein the oil block is configured to store oil.

7 Claims, 11 Drawing Sheets

HIGH-SPEED CHAIN CUTTER APPARATUS TO CLEAN AND DESCALE PIPES

RELATED APPLICATION

This application claims priority to provisional patent application U.S. Ser. No. 63/013,397 filed on Apr. 21, 2020, the entire contents of which is herein incorporated by reference.

BACKGROUND

The embodiments described herein relate generally to cutting and pipe cleaning devices and, more particularly, to a high-speed chain cutter apparatus that cleans and descales pipes.

Water and waste line pipes have to be cleaned, descaled, and/or unclogged during their lifetime. Current devices for addressing these issues include products, such as the Picote Miller Units, which comprise an electric motor that drives a cable for use in drain cleaning, pipe cutting, and the like.

These Picote Miller devices are undesirable due to performance, safety, and maintenance issues. More specifically, these devices generally comprise motors that are rated up to approximately 1800 rpms to rotate the connected cable. These motors' specifications are not powerful enough for the most demanding pipe cleaning and chain cutting applications. In addition, these devices have safety concerns because the rotating cable is prone to flip and/or bend, which can cause injury to the operator. Finally, maintenance on these devices, such as lubricating the cable, is tedious and inefficient. Specifically, the cable has to be disassembled from the device, lubricated, and reassembled.

Therefore, what is needed is a high-speed chain cutter apparatus for cleaning and descaling pipes that addresses the limitations of the prior art, which thus enhances performance and user safety. There is a further need for the apparatus to improve maintenance efficiency and reduce costs by providing a cable that lubricates itself during operation.

SUMMARY

Some embodiments of the present disclosure include a high-speed chain cutter apparatus with a self-lubrication capability that is configured to clean and descale a pipe. The cutter apparatus may include a basket plate mounted to a cart frame; a motor coupled to the basket plate; a cable having a proximal end and a distal end, wherein the proximal end is operably coupled to the motor; an outer tubular member disposed around the cable and positioned to expose both a first portion of the cable proximate to the proximal end and the distal end of the cable; and an oil block coupled to the basket plate, wherein the oil block includes a bore, wherein the first portion of the cable extends through the bore and wherein the oil block is configured to store oil.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
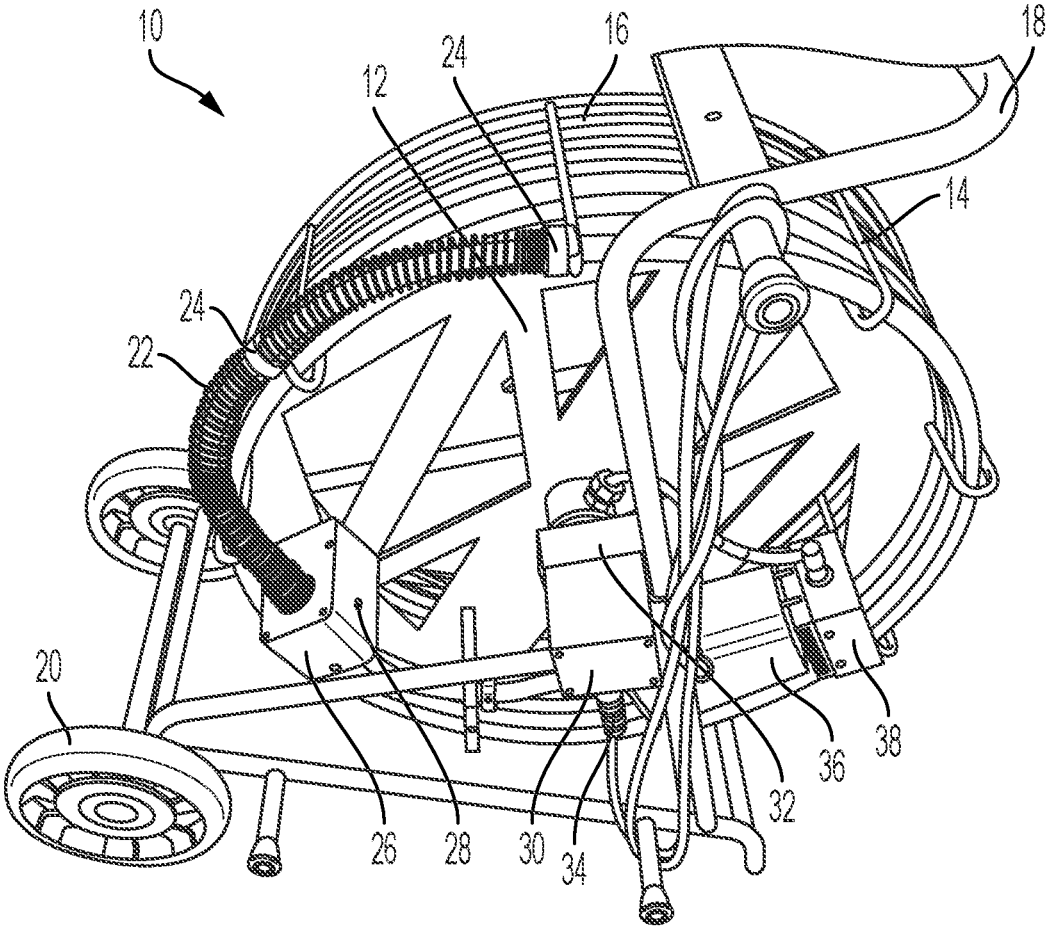
FIG. 1 is a perspective view of one embodiment of the present disclosure.
Figure 2:
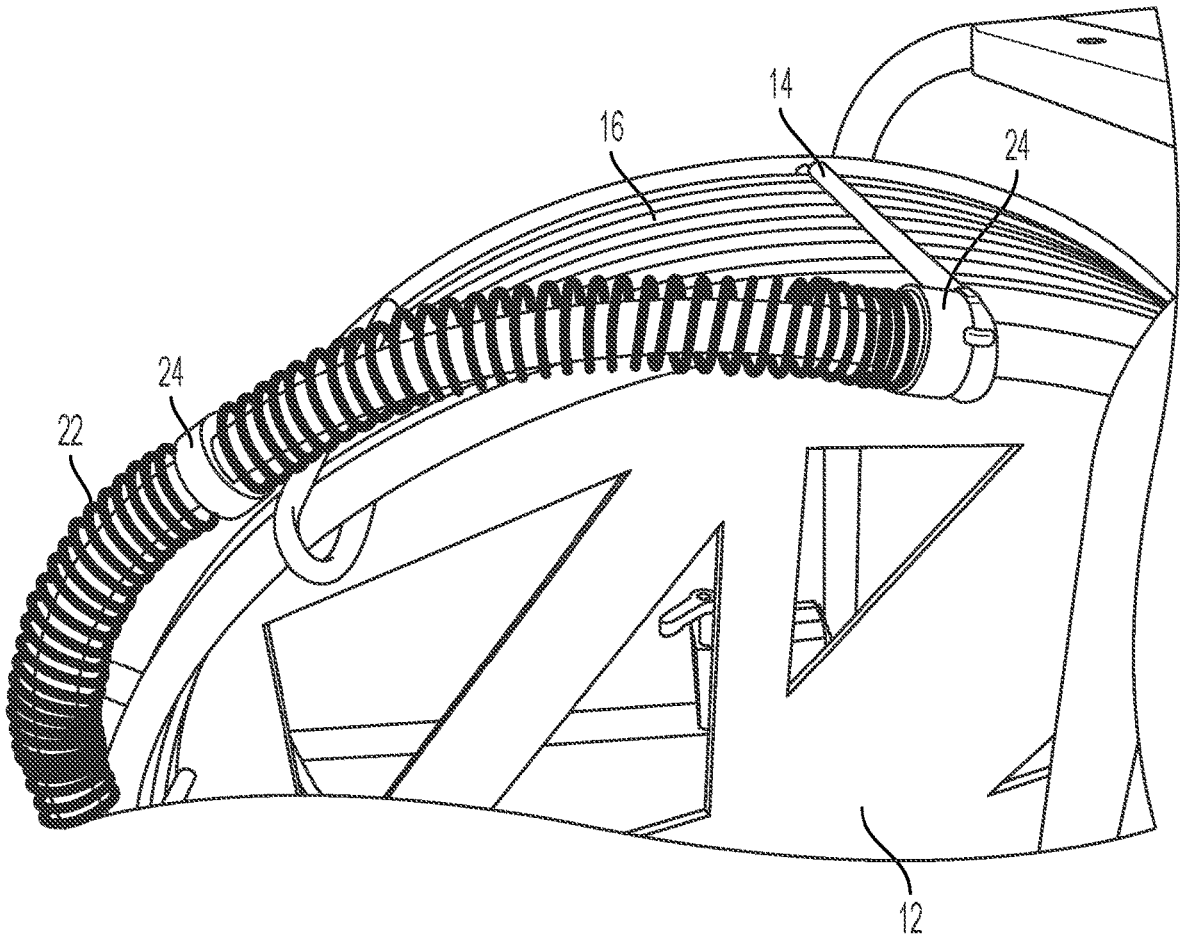
FIG. 2 is a detail perspective view of a portion of one embodiment of the present disclosure.
Figure 3:
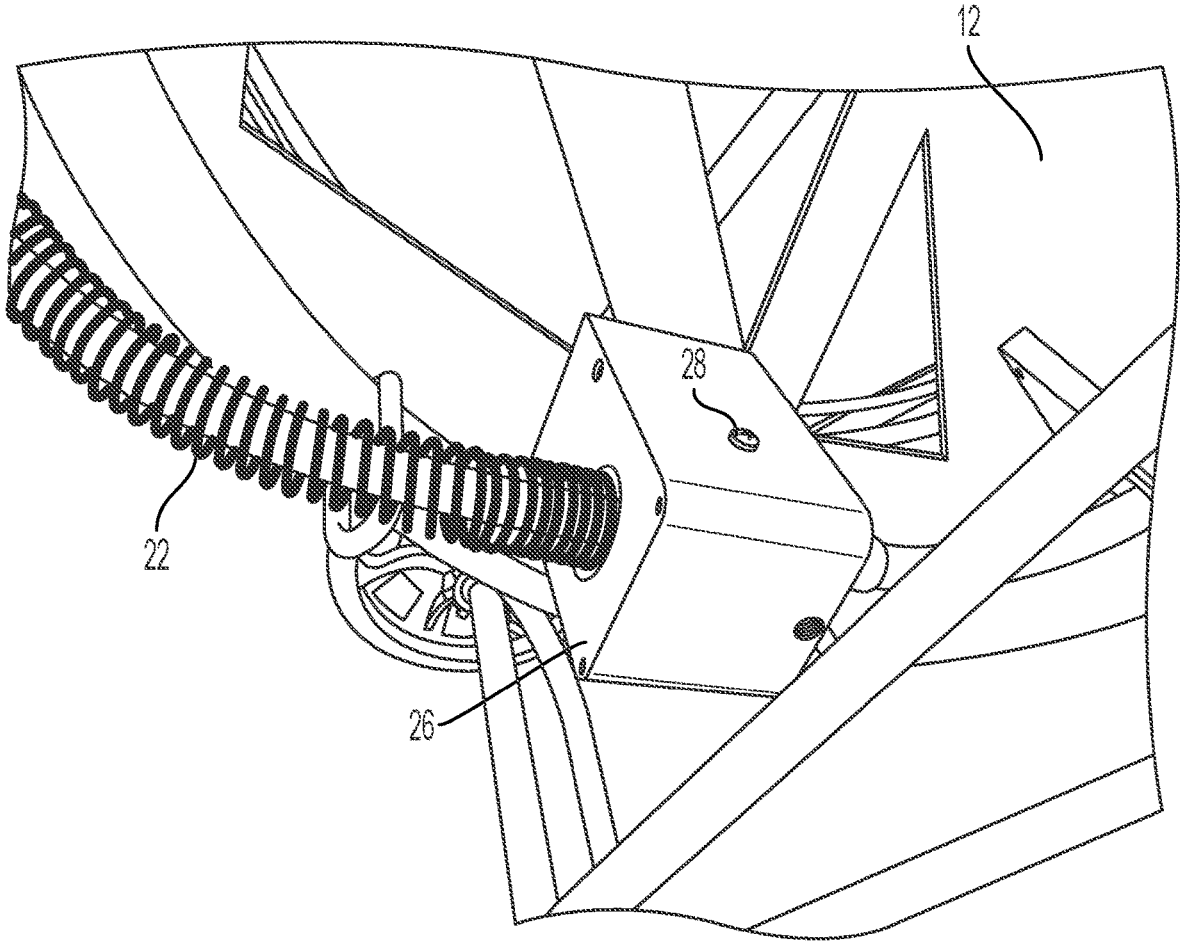
FIG. 3 is a detail perspective view of a portion of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a high-speed chain cutter apparatus for cleaning and descaling pipes and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements and the following examples are presented as illustrative examples only.

By way of example, and referring to FIGS. 1-11, some embodiments of the invention include a high-speed chain cutter apparatus 10 configured to clean, descale, and prepare pipes that transport water, waste, or other materials. The high-speed cutter apparatus 10 generally comprises a motor 36 operably connected to a cable 52, such as a speed shaft cable, which is configured to clean 2 to 6 inch diameter pipe lines with ease, wherein the cable 52 may have a tubular member 16 disposed there around. When the motor 36 is powered ON, the motor 36 may cause the cable 52 to rotate. In some embodiments, the apparatus 10 comprises a motor 36 with rotational speeds of up to about 3200 RPMS, which allows the rotating cable 52 to run smoothly in a variety of applications, even in the harshest applications. Due to its design, the cable 52 in its operational mode does not flip, which enhances user safety.

In embodiments, the cutter apparatus 10 may comprise a basket plate 12 mounted to a cart frame 18, wherein the basket plate 12 serves as a mounting assembly for the motor 36 and to secure the cable 52 in a storage position when not in use. The cart frame 18 may define a support skeleton to which the basket plate 12 is mounted. For example, the cart frame 18 may include an axle 58 extending through and attached to the basket plate 12 using a mechanical fastener, such as mounting screws 60. One end of the axle 58 may comprise a basket lock 54 attached thereto, wherein the basket lock/break 54 may be configured to prevent the axle 58 and, thus, the basket plate 12 from rotating. The basket lock/break 54 may include a cut block, such as a plastic or metal block, that has a gap cut out. When the block is squeezed or pinched, the hole for axle 58 may shrink in size, thus squeezing down on the axle 58.

The cart frame 18 may include a handle, support arms, support legs with wheels 20 attached thereto, and the like, wherein the cart frame 18 is configured to allow the apparatus 10 to stand in place or, upon tipping, be wheeled for easy transport.

As shown in the Figures, the basket plate 12 may comprise a substantially planar and circular support member with a plurality of cutouts extending there through, wherein the cable 16 wraps around an outer periphery thereof when not in use. In some embodiments, a plurality of basket securing members 14 may extend from the outer edge of the basket plate 12, wherein the basket-securing members 14 comprise substantially looped members configured to secure the cable 52 around the basket plate 12. The basket plate 12 is preferably made from a durable metal, but the use of other materials known in the art is also envisioned. Similarly, the basket-securing members 14 may comprise a metal or other durable material, such as a piping material, bent into an elongated loop.

In embodiments, the motor 36 may be coupled to a side surface of the basket plate 12 using mechanical fasteners or other fastening components. In a particular embodiment, the motor 36 may be operatively attached to a motor mount 44, which may be mounted to the basket plate 12. In another embodiment, additional mounting components, such as brackets or clamps, may be used to secure the motor 36 to the basket plate 12. In a preferred embodiment, the motor 36 is a variable-speed, clutchless, DC motor with an operating speed of from 0 to 3200 RPMs at less than 15 Amps AC power. In an alternative embodiment, the specifications of the motor may vary.

In embodiments, the motor 36 may be powered by an electrical power source and may be operated with a motor controller 38. In some embodiments, the apparatus 10 may comprise a drive hub 30 with a drive hub support 32 operatively attached to the apparatus 10 and to the motor 36, wherein the drive hub 30 has a power cord 34 attached thereto, such that when the power cord 34 is connected to an external power source, the drive hub 30 is activated, causing the motor 36 to operate. The drive hub 30 may contain a high power slip ring and heavy duty metal bearing, allowing the basket 12 to rotate and supply power to the DC motor.

In some embodiments, the motor controller 38 may be operatively attached to a pedal or hand switch (not shown). In one embodiment, a pedal or hand switch may be operably connected to the motor 36 and serves as an open circuit switch. Depressing the pedal or hand switch may turn the motor ON or OFF, as desired. In one embodiment, a pedal or hand switch may be operably connected to a potentiometer, which may be operably connected to the motor 36. In this embodiment, the pedal or hand switch may serve as an open circuit switch and speed control input mechanism. Depressing and releasing the second pedal may turn the motor 36 ON or OFF, as desired. The degree of depression of the pedal or hand switch, together with the use of the potentiometer may control the operating speed of the motor 36 within the approximate range of from 0 to about 3200 RPMs.

In some embodiments, the apparatus 10 may further comprise an axle 58 extending through and secured within a centrally located orifice on the basket plate 12, such that the basket plate 12 is configured to rotate with rotating of the axle 58. In some embodiments, the axle 58 may be secured to the basket plate 12 using a mechanical fastener, such as a mounting screw 60.

As shown in the Figures, the cutter apparatus 10 may comprise a cable 52 coupled to the motor 36. The cable 52 may be made from metal or any other material known in the field. The cable 52 may comprise a proximal end operably connected to the motor 36 by a motor connector 48 and a distal end. In some embodiments, the cable 52 may comprise a helical or spiral outer pattern with a length of about 65 feet long. However, the dimensions of the cable 52 may vary, as desired or required. For example, the cable 52 may comprise a larger outer diameter wire (i.e., 0.135 inches) that is woven tightly around smaller opposite wound support wires (0.03 inches), thus increasing cable strength and reducing friction on the outer tubular member 16. The diameter of the outer wire and support wires may vary for more flex and more strength.

In some embodiments, it shall be appreciated that any number of additional extension cables may be connected together and connected to the main cable 52 attached to the motor 36, wherein connecting the cables together may be accomplished by using a variety of connectors, such as button-lock, speed connect, and/or snap connect components. In one embodiment, each extension cable may comprise the helical or spiral outer pattern and may have a length of about 25 feet, about 50 feet, or any other desired length. In one embodiment, any variety of cutting tools or other components may be connected to one of the cables using one of the variety of connectors. For example, particular embodiments the distal end of the cable 52 may comprise a speed connector 50 attached to a distal end thereof, wherein the speed connector 50 allows for the attachment of other cables, tools, or components without requiring that the cable 16 be shortened.

As shown in the Figures, the speed connector 50 may comprise a round male shaft end with a raised, spring loaded button lock pin on one side. When inserted into the round female speed connector, the raised spring loaded button lock may protrude into a side hole in the female connector. The connector's cable ends may be threaded on the cable and then crimped on with a press, such as a 10-50 ton press. A fill weld hole may be added onto the crimp end in case the crimp becomes loose over time.

Figure 8:
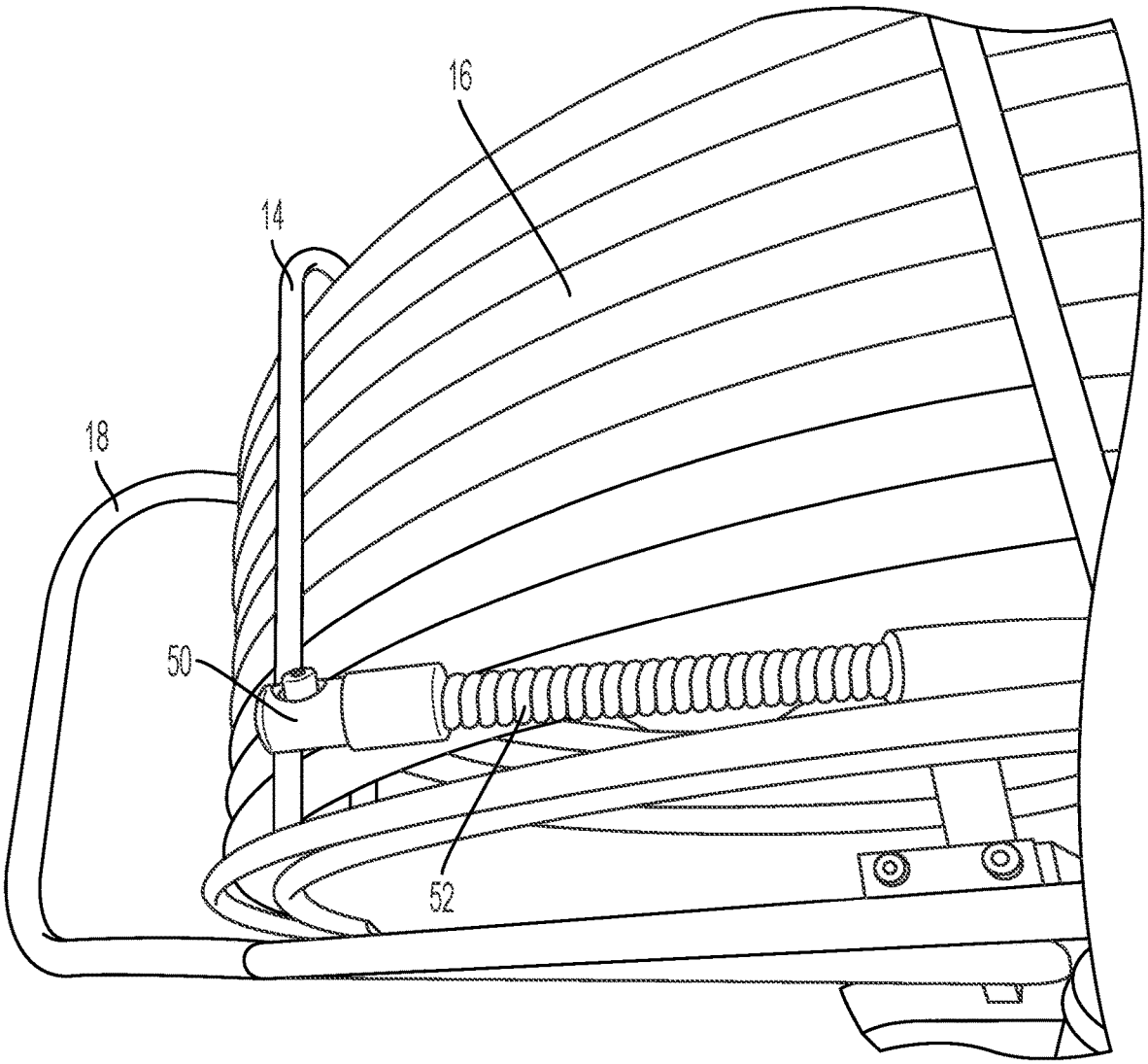
FIG. 8 is a detail perspective view of a portion of one embodiment of the present disclosure.
Figure 9:
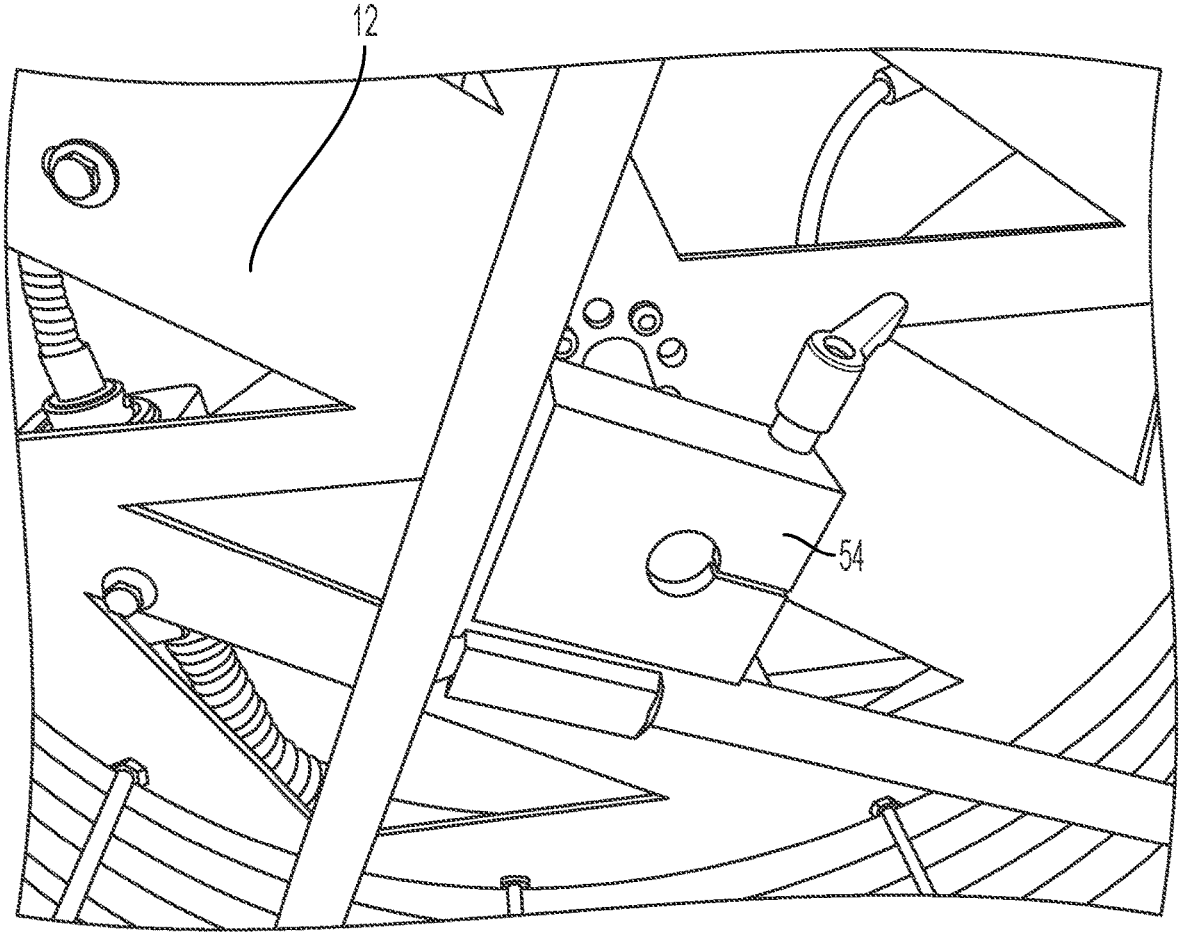
FIG. 9 is a detail perspective view of a portion of one embodiment of the present disclosure.

As shown in the Figures, the apparatus 10 may comprise an outer tubular member 16 that is disposed around the cable 52. The outer tubular member may serve as a protective sheath and is preferably made from polyethylene, plastic, or other similar-type material. The outer tubular members may comprise a length sufficiently long to cover the majority of the length of the cable 52, except the distal end of the cable 52, as shown in FIG. 8, and an upper portion of the cable proximate to the proximal end, each of which may remain exposed.

The apparatus 10 of the present disclosure may further comprise an oil block 26 operatively mounted to the basket plate 12 using, for example, mechanical fasteners. The oil block 26 may be configured to self-lubricate the cable 52 during operation of the apparatus 10. In embodiments, the oil block 26 may comprise a metal block housing, which may have variable shapes. In a particular embodiment, the oil block 26 comprises a generally rectangular block with a main bore extending entirely through the block. The oil block 26 may comprise any number of inlets 28 that connect to the main bore, wherein oil may be poured into the one or more inlets 28 in the oil block 26.

Figure 4:
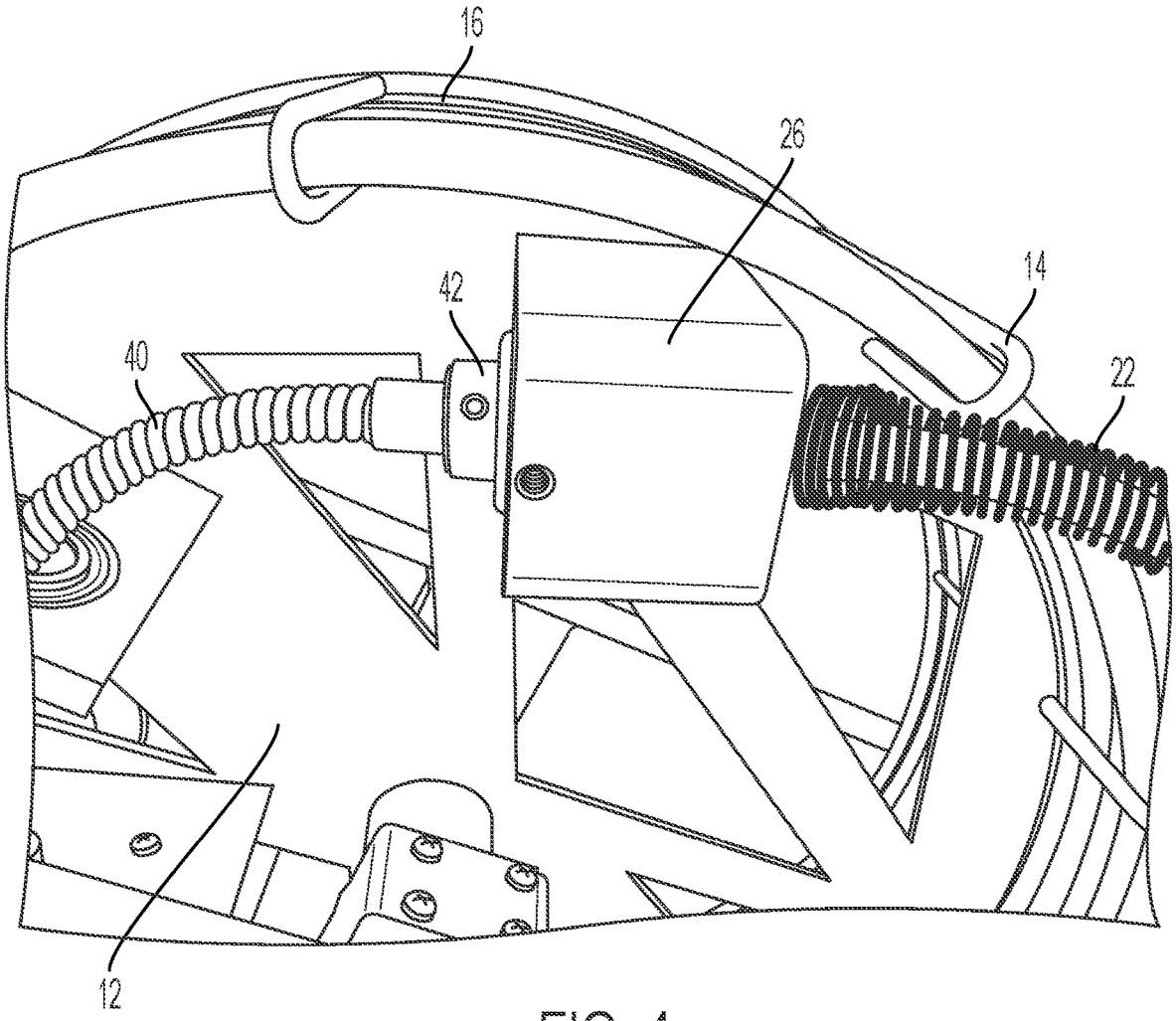
FIG. 4 is a detail perspective view of a portion of one embodiment of the present disclosure.

In embodiments, the oil block 26 may be mounted to the basket plate 12 using mechanical fasteners or alternative fastening components and may be positioned such that its main bore extends over the motor connector 48 that attaches the cable 52 to the motor 36, the upper exposed portion 40 of the cable 52 proximate the proximal end, and a portion of the outer tubular member 16 adjacent to the upper exposed portion of the cable 52. Specifically, and as shown in FIG. 4, the upper exposed portion 40 of the cable 52 may be operatively attached to the oil block 26 by, for example, an oil block bearing 42, wherein the upper exposed portion 40 extends through the oil block bearing 42 and into the main bore of the oil block 26. When the cable 52 extends out of the opposite side of the oil block 26, it may be covered by the outer tubular member 16. Thus, the outer tubular member 16 may be secured to the oil block 26 by a plate, which may be fastened to both the oil block 26 and the outer tubular member 16, wherein the connection may prevent the outer tubular member 16 from moving out of place during operation of the apparatus 10.

Moreover, as shown in FIGS. 1-4, a spring guide 22 may be disposed around an outer periphery of the outer tubular member 16, such that the spring guide 22 encircles the cable 52 and outer tubular member 16 for a portion of a length thereof. In a particular embodiment, a pair of spring guides 22 may encircle the outer tubular member 16, wherein the pair of spring guides 22 may be separation by a spring guide sleeve 24. An additional spring guide sleeve 24 may be positioned around the outer tubular member 16 at an end of the last spring guide 22, wherein the positioning of the spring guide sleeves 24 may align with and abut the basket-securing members 14.

Figure 5:
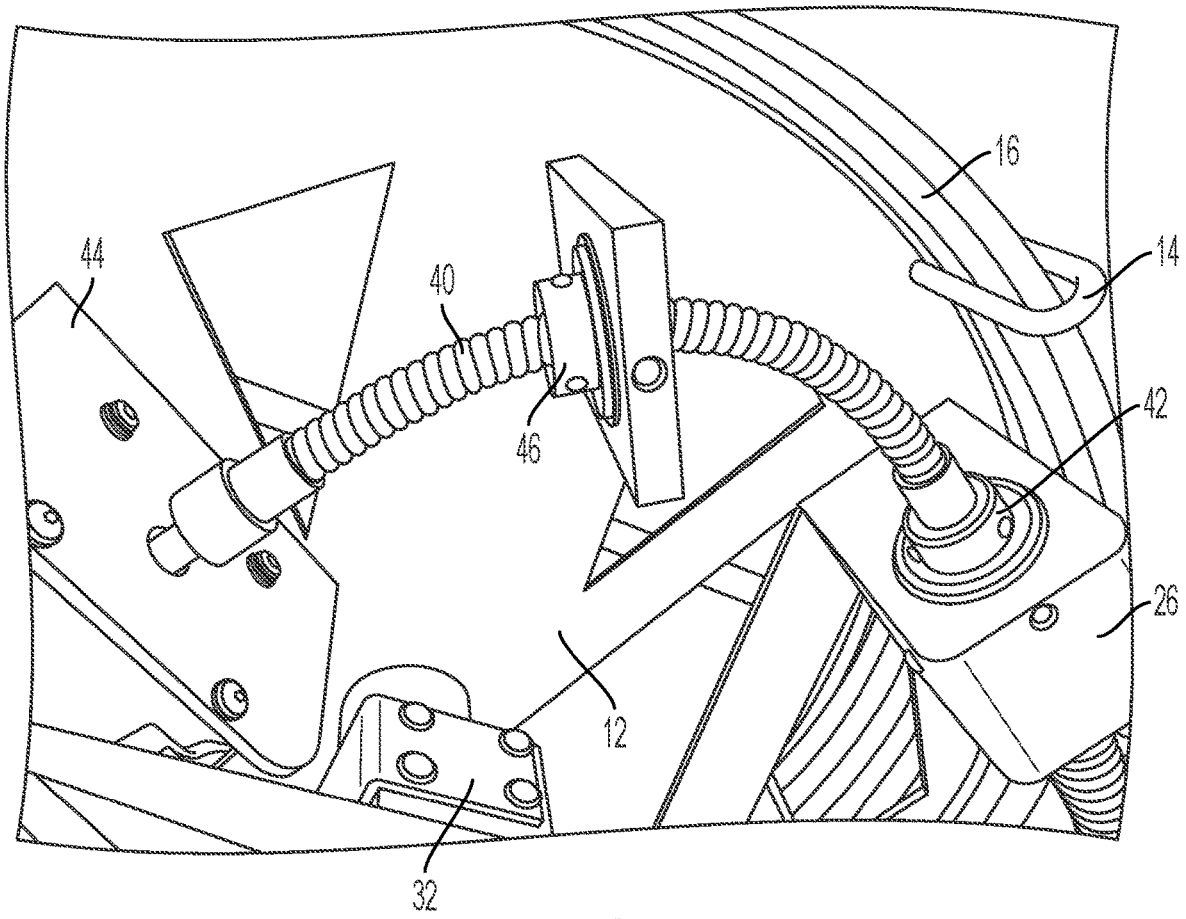
FIG. 5 is a detail perspective view of a portion of one embodiment of the present disclosure.
Figure 6:
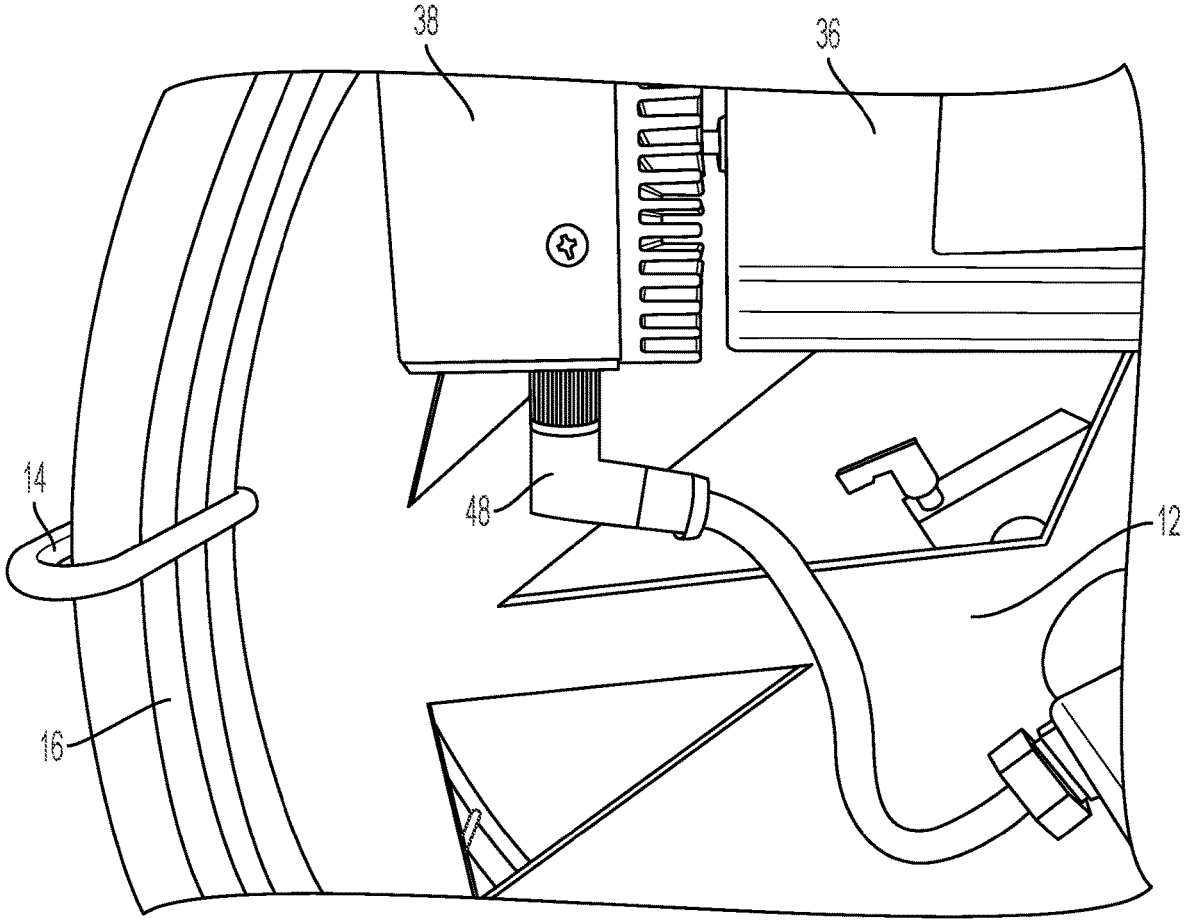
FIG. 6 is a detail perspective view of a portion of one embodiment of the present disclosure.
Figure 7:
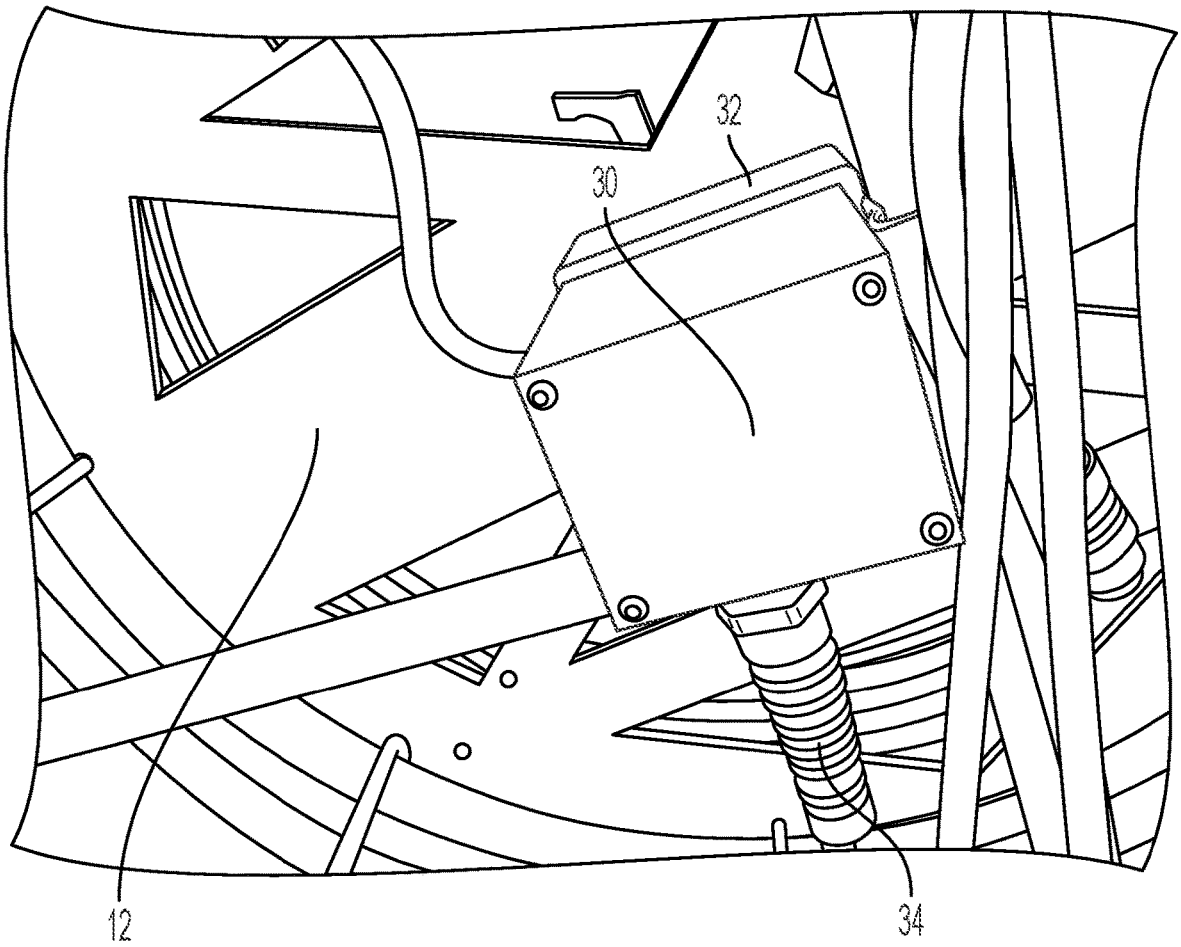
FIG. 7 is a detail perspective view of a portion of one embodiment of the present disclosure.

In embodiments, and as shown in FIG. 5, the upper exposed portion 40 of the cable 52 may have a distal end connected to a the motor 36 through the motor mount 44 and a proximal end extending into the oil block 26. Between the motor 36 and the oil block 26, the upper exposed portion 40 of the cable 52 my pass through a drive block and bearing 46. The drive block and bearing 46 may function as a vibration dampener for the spring drive. In embodiments, the apparatus may include a plastic vibration dampener bushing on the drive spring (not shown), wherein the plastic vibration dampener bushing secures the drive spring at the radius turn in the bearing and absorbs any unwanted vibration. Without the plastic vibration dampener bushing, the drive block and bearing, the drive spring may quickly fatigue and fail.

Figure 10:
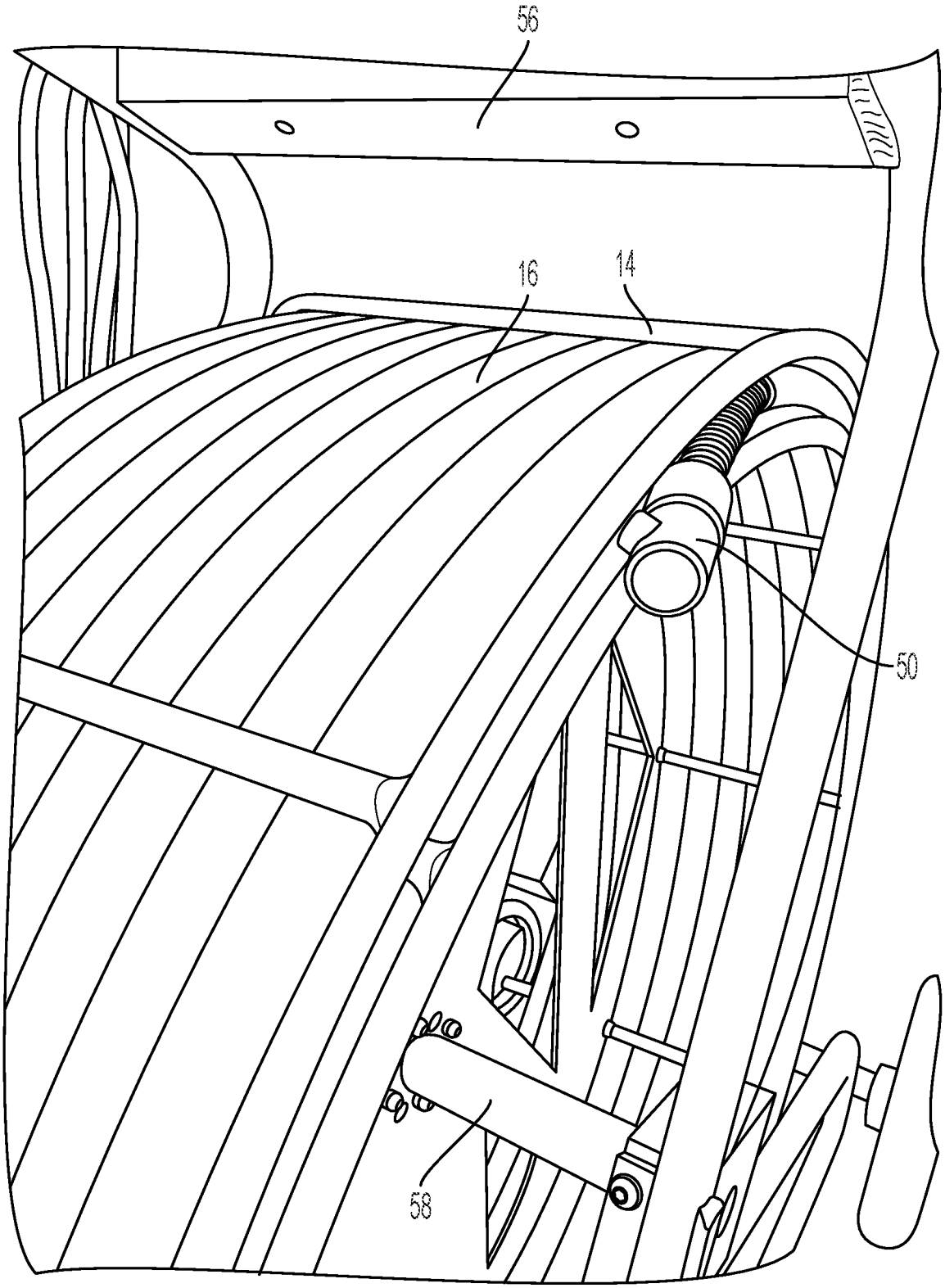
FIG. 10 is a detail perspective view of a portion of one embodiment of the present disclosure.
Figure 11:
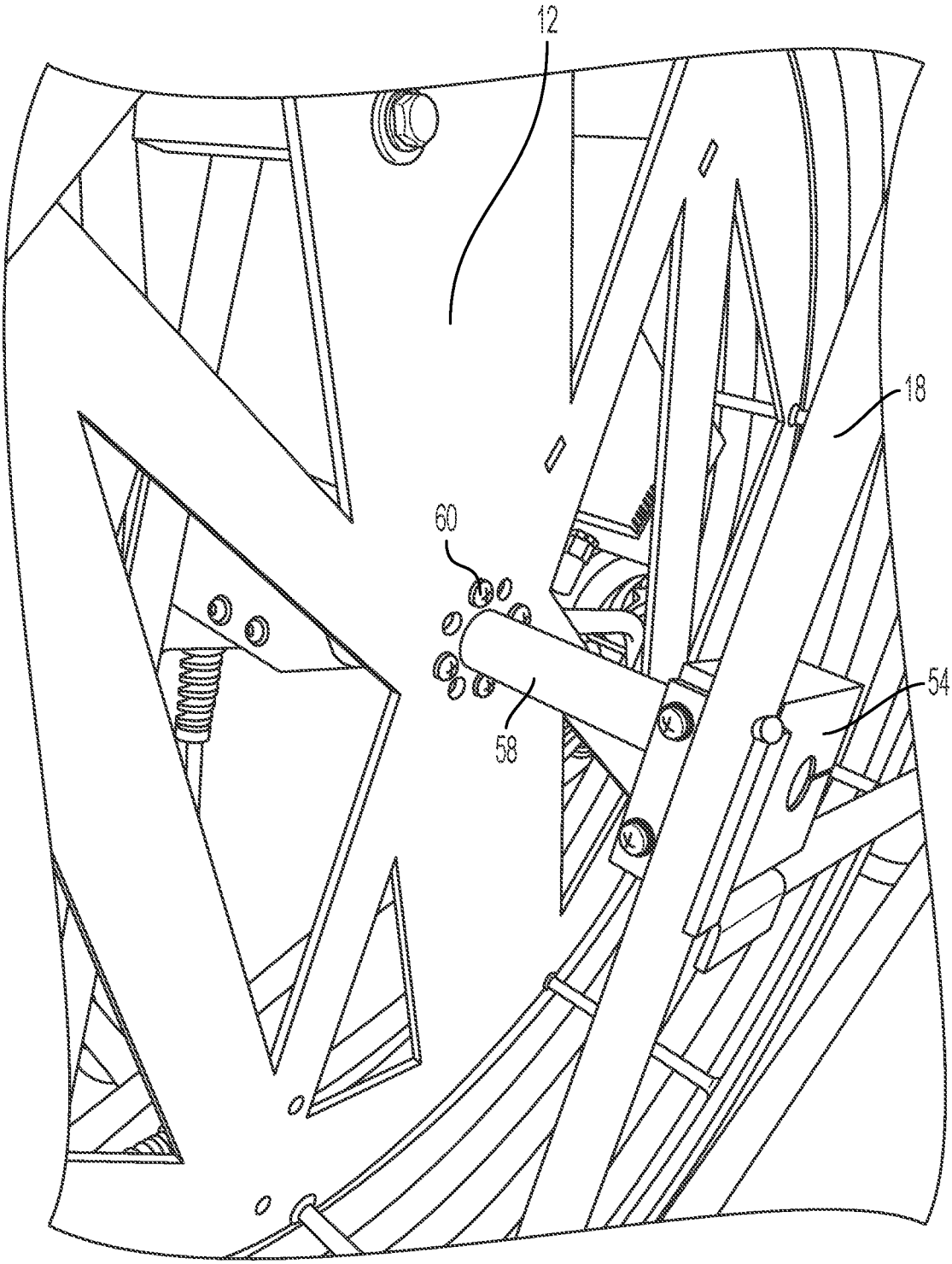
FIG. 11 is a detail perspective view of a portion of one embodiment of the present disclosure.

As shown in FIG. 10, the cart frame 18 may include a control box T-bar mount 56 attached thereto. The T-bar mount 56 may provide a mount for attaching the power control box to the cart.

In operation, the high-speed chain cutter apparatus 10 is used to clean and descale the interior of a pipe or conduit. In certain embodiments, the cable 52 and tubular member 16 are pulled in extension from the basket plate 12. The operator depresses a pedal or other control mechanism to activate the motor 26, which may drive the cable 52. A potentiometer at the power control box or pedal attached to the power control box may be used to control the speed of rotation of the motor 26 and attached cable 52. During this time, the outer tubular member 16 may remain stationary. The operator may insert the exposed distal end of the cable 52 and outer tubular member 16 into the interior of the pipe, wherein the rotating exposed distal end of the cable 52 may directly contact the interior surface of the pipe to clean and/or descale it. The operator continues to feed the cable 52 and outer tubular member 16 into the pipe to clean and/or descale the entire surface of the pipe.

During the operation of the apparatus, the cable 52 may self-lubricate itself via the oil block 26. Specifically, oil stored within or poured into the oil block 26 may flow through its main bore to the upper exposed portion of the cable 52. Rotation of the cable 52 allows the oil to automatically flow within the outer tubular member 16 through the entirety of the outer spiral/helical surfaces of the cable 52 to the distal end of the cable 52. As such, the cable 52 is continuously lubricated during the operation of the apparatus 10 so long as the oil block 26 houses oil.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A high-speed chain cutter apparatus with a self-lubrication capability that is configured to clean and descale a pipe, the cutter apparatus comprising:

a basket plate mounted to a cart frame;

a motor coupled to the basket plate;

a cable comprising a proximal end and a distal end, wherein the proximal end is operably coupled to the motor;

an outer tubular member disposed around the cable and positioned to expose both a first portion of the cable proximate to the proximal end and the distal end of the cable; and an oil block coupled to the basket plate, wherein the oil block comprises a bore, wherein the first portion of the cable extends through the bore and wherein the oil block is configured to store oil, wherein:

the cable and the outer tubular member are configured to insert within the pipe with the motor engaged, thereby allowing the motor to rotatably drive the cable such that the exposed distal end directly contacts an inner surface of the pipe; and the oil from the oil block is configured to travel from the first portion of the cable to the distal end as the motor drives the cable, thereby lubricating the cable during operation.

2. The cutter apparatus of claim 1, wherein the cable comprises an outer surface with a pattern selected from the group consisting of a helical pattern and a spiral pattern.

3. The cutter apparatus of claim 1, further comprising a speed connector attached to the distal end of the cable.

4. The cutter apparatus of claim 1, further comprising a spring guide encircling a portion of a length of the cable and the outer tubular member extending from the oil block.

5. The cutter apparatus of claim 4, further comprising a second spring guide encircling a second portion of the length of the cable and the outer tubular member extending from the oil block, wherein a spring guide sleeve is positioned between the spring guide and the second spring guide.

6. The cutter apparatus of claim 1, wherein the cable has a diameter of from about 8 mm to about 12 mm.

7. The cutter apparatus of claim 6, wherein the cable comprises a larger outer diameter wire that is woven tightly around a plurality of smaller oppositely wound support wires.

* * * * *